US008765348B2

(12) United States Patent
Ganapathiappan et al.

(10) Patent No.: US 8,765,348 B2
(45) Date of Patent: Jul. 1, 2014

(54) LIQUID TONER INCLUDING LATEX PARTICLES

(75) Inventors: Sivapackia Ganapathiappan, Los Altos, CA (US); Hou T. Ng, Campbell, CA (US); Albert Teishev, Rishon le-zion (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 115 days.

(21) Appl. No.: 13/353,040

(22) Filed: Jan. 18, 2012

(65) Prior Publication Data

US 2013/0183619 A1 Jul. 18, 2013

(51) Int. Cl.
*G03G 9/13* (2006.01)
*G03G 9/135* (2006.01)

(52) U.S. Cl.
USPC ..... 430/115; 430/137.17; 430/137.22

(58) Field of Classification Search
USPC ..... 430/115, 112, 137.22, 137.17
See application file for complete search history.

(56) References Cited

U.S. PATENT DOCUMENTS

| | | | | |
|---|---|---|---|---|
| 4,241,159 | A | | 12/1980 | Priem et al. |
| 4,762,764 | A | | 8/1988 | Ng et al. |
| 5,393,633 | A | * | 2/1995 | Furukawa et al. ..... 430/114 |
| 5,437,953 | A | | 8/1995 | Russell et al. |
| 6,174,936 | B1 | | 1/2001 | Kato |
| 6,184,267 | B1 | | 2/2001 | Kato et al. |
| 2002/0156156 | A1 | | 10/2002 | Gore |
| 2009/0162779 | A1 | | 6/2009 | Nair et al. |
| 2011/0200817 | A1 | | 8/2011 | Duckworth |

FOREIGN PATENT DOCUMENTS

| | | | |
|---|---|---|---|
| JP | 2008-170563 | * | 7/2008 |
| WO | WO 2009/014855 | | 1/2009 |
| WO | WO 2009/151446 | | 12/2009 |
| WO | WO 2010/120278 | | 10/2010 |

OTHER PUBLICATIONS

Whelan, Tony, consultant, Polymer Technology Dictionary, Chapman & Hall, London (1994), pp. 218-219.*
Japanese Patent Office machine-assisted English-language translation of JP 2008-170563 (pub. Jul. 2008).*
Specialty Polymers, Inc., RayRez 182A Technical Bulletin, pub. Jul. 16, 2010.*

* cited by examiner

*Primary Examiner* — Janis L Dote

(57) ABSTRACT

A liquid toner is disclosed herein. The liquid toner includes a toner composition with latex particles incorporated therein. The toner composition includes charged toner particles incorporated into a non-polar liquid carrier. The latex particles are polymer particles of acrylic monomers, vinylic monomers, or mixtures thereof, and each latex particle has a particle size ranging from about 20 nm to about 5 μm.

16 Claims, 3 Drawing Sheets

LIQUID TONER INCLUDING LATEX PARTICLES

BACKGROUND

The present disclosure relates generally to liquid toners including latex particles.

Toners may be used in various commercial printers including digital printers. The toner may, in some instances, be formulated into a liquid form, and this liquid toner may contain a resin incorporated into a liquid carrier. In some instances, pigments and/or dyes may also be incorporated into the liquid carrier to add color to the toner.

BRIEF DESCRIPTION OF THE DRAWINGS

Features and advantages of examples of the present disclosure will become apparent by reference to the following detailed description and drawings, in which like reference numerals correspond to similar, though perhaps not identical, components. For the sake of brevity, reference numerals or features having a previously described function may or may not be described in connection with other drawings in which they appear.

FIG. 1E alone schematically depicts an example of another method of making an example of the liquid toner;

DETAILED DESCRIPTION

Figures 1A, 1B, 1C, 1D, 1E:
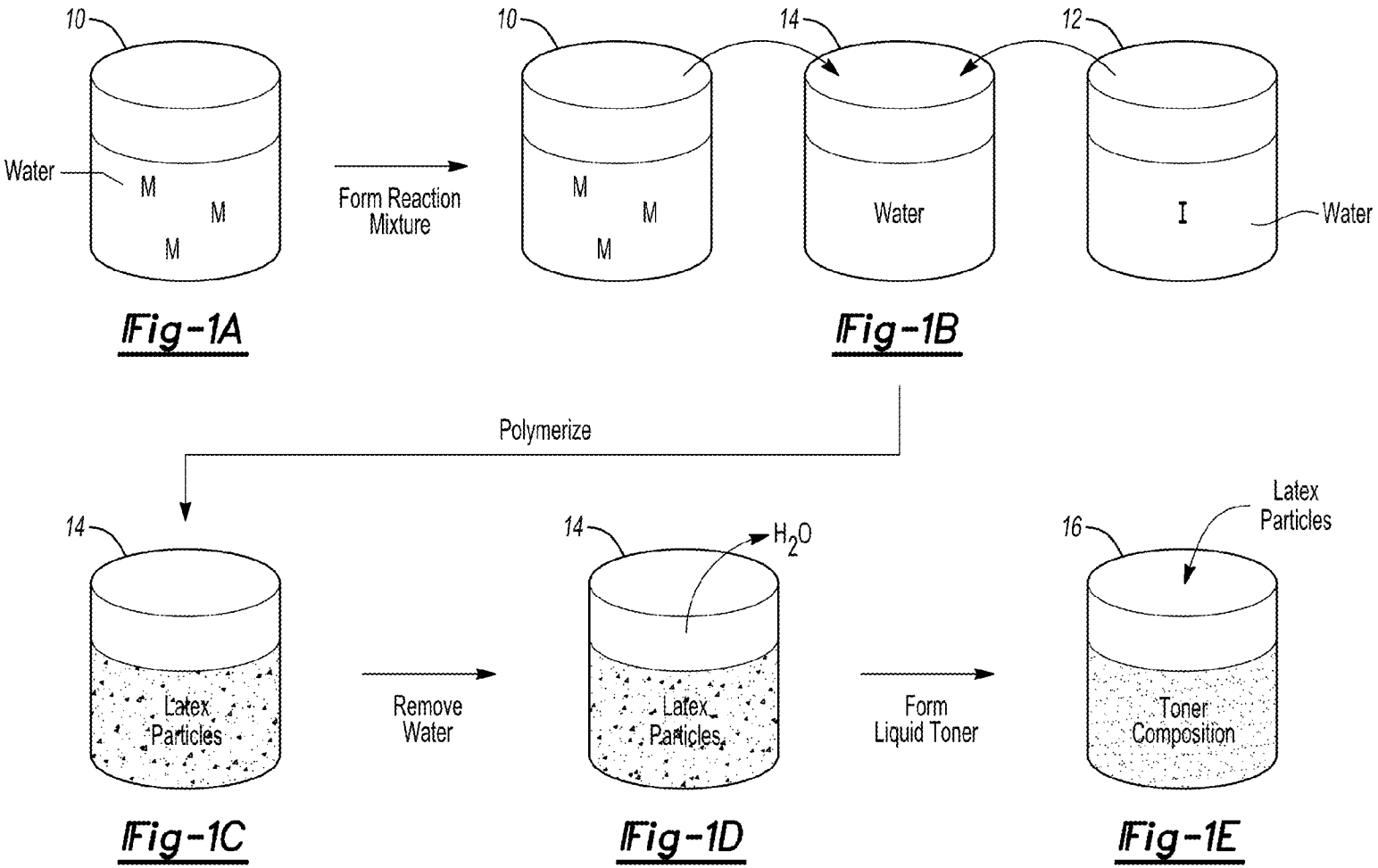
FIGS. 1A through 1E together schematically depict a flow diagram of an example of a method of making an example of a liquid toner.

Example(s) of the liquid toner as disclosed herein include a toner composition having latex particles incorporated therein. By virtue of the type of latex particles selected for the liquid toner and the particle size of the individual latex particles, the toner retains its durability while being readily printable by a digital printer, such as a liquid electrophotographic (LEP) printer. The latex particles may be polymer particles of acrylic monomers, vinylic monomers, or mixtures thereof, where the polymer particles have an individual particle size (in terms of effective diameter assuming that each particle may not be perfectly spherical) ranging from about 20 nm to about 5 μm. The latex particles may also form aggregates, where the aggregates are up to about 3 μm in size. It has been found that the liquid toner including these latex particles produces prints (i.e., a print medium having the liquid toner printed thereon) which are waterfast, lightfast, and are suitably resistant to scratching. This is in contrast to liquid toners including polyethylene-based particles alone, which when dispersed in a hydrocarbon carrier (such as, e.g., ISOPAR® L), may be too soft to produce a suitably durable liquid toner. For instance, liquid toners including polyethylene-based particles alone may exhibit suitable waterfastness and lightfastness; however, the liquid toners may be deficient in terms of scratch resistance. The deficiency in scratch resistance for a liquid toner including polyethylene-based particles relative to an example of the liquid toner disclosed herein is shown, e.g., in FIGS. 4A and 4B. These figures will be described in further detail in the Examples below.

As briefly mentioned, the examples of the liquid toner may be printed by a digital printing system, such as an LEP printer. The LEP printer generally utilizes an electrophotographic printing technique to produce an ink image on a print medium. Via this printing technique, the ink image is electrostatically transferred from a photo imaging plate, photoreceptor, photoconductor, or the like to an intermediate drum or roller. The ink image is then transferred to a substrate. In one example, the photo imaging plate is a photoconductive surface that is used to develop a hardcopy of the image. The photoconductive surface is selectively charged with a latent electrostatic image having both image and background areas. The liquid toner, which includes charged toner particles dispersed in a carrier liquid, is brought into contact with the selectively charged photoconductive surface. The charged toner particles adhere to the image areas of the latent image while the background areas remain free of ink. The ink is transferred to the intermediate drum, and then a hardcopy material (e.g., paper or other print substrate) is brought directly or indirectly into contact with the intermediate drum in order to transfer the latent image. It is to be understood that, in at least some of the examples disclosed herein, the liquid toner is specifically formulated to be printable from an LEP printer or another device that utilizes an electrophotographic printing technique to produce a print.

Examples of the liquid toner will now be described herein. In each of these examples, the liquid toner includes a toner composition having the latex particles incorporated therein. In an example, the toner composition is a liquid that contains a non-polar liquid carrier, and charged toner particles incorporated in the carrier.

The non-polar liquid carrier acts as a dispersing medium for the other component(s) of the toner composition (e.g., the charged toner particles, etc.). Generally, the non-polar liquid carrier has properties such as low odor, lack of color, selective solvency, oxidation stability, low electrical conductivity, low surface tension, desirable wetting, spreadability, low viscosity, narrow boiling point range, non-corrosive to metals, low freezing point, high electrical resistivity, high interfacial tension, low latent heat of vaporization, and low photochemical reactivity. Further, the carrier is selected to have a low field conductivity (e.g., less than 200 pS/cm) so that the carrier can be easily removed during a digital printing process (e.g., by rollers of currently existing LEP printers).

The non-polar carrier may be chosen from hydrocarbon-based carriers, such as aliphatic (linear/acyclic or cyclic) hydrocarbons, branched-chain aliphatic hydrocarbons, etc. In one example, the liquid carrier is an isoparaffinic hydrocarbon, such as ISOPAR® L available from Exxon Mobile, Houston, Tex. Another example of the liquid carrier is an oil, such as silicone oil, soy bean oil, vegetable oil, plant extracts, and/or the like. In another example, the liquid carrier is a low polarity hydrocarbon; i.e., a hydrocarbon having a dielectric constant that is less than 4. The liquid carrier may, for instance, be chosen from one or more hydrocarbons, one or more oils, or combinations of hydrocarbon(s) and oil(s). Further, the amount of the liquid carrier may range from about 1 wt % to about 98 wt % of the liquid toner. In another example, the amount of the liquid carrier may range from about 80 wt % to about 96 wt % of the liquid toner.

The charged toner particles are made up of pigment particles encapsulated with polymer resin. The encapsulated pigment particles also have a charge director attached thereto or otherwise associated with a surface thereof, which imparts a charge to the pigment particles.

The pigment particles making up the core of the charged toner particles may be chosen from organic pigment particles or inorganic pigment particles, and these particles may have any particle size (i.e., effective diameter) that allows the toner to be printed from, e.g., an LEP printer. In an example, the size of the pigment particles ranges from about 50 nm to about 3 μm. The charged toner particles may also form aggregates, where the aggregates are up to about 3 μm in size. Organic or inorganic pigment particles may be selected from black pigment particles, yellow pigment particles, magenta pigment particles, red pigment particles, cyan pigment particles, blue pigment particles, green pigment particles, orange pigment particles, brown pigment particles, and white pigment particles. In some instances, the organic or inorganic pigment particles may include spot-color or specialty pigment particles. Spot-color pigments are formed from a combination of a predefined ratio of two or more primary color pigment particles. Specialty pigments may, e.g., be metallic, fluorescent and/or opalescent pigments.

An example of suitable inorganic black pigment includes carbon black. Examples of carbon black pigments include those manufactured by Mitsubishi Chemical Corporation, Japan (such as, e.g., carbon black No. 2300, No. 900, MCF88, No. 33, No. 40, No. 45, No. 52, MA7, MA8, MA100, and No. 2200B); various carbon black pigments of the RAVEN® series manufactured by Columbian Chemicals Company, Marietta, Ga., (such as, e.g., RAVEN® 5750, RAVEN® 5250, RAVEN® 5000, RAVEN® 3500, RAVEN® 1255, and RAVEN® 700); various carbon black pigments of the REGAL® series, the MOGUL® series, or the MONARCH® series manufactured by Cabot Corporation, Boston, Mass., (such as, e.g., REGAL® 400R, REGAL® 330R, and REGAL® 660R); and various black pigments manufactured by Evonik Degussa Corporation, Parsippany, N.J., (such as, e.g., Color Black FW1, Color Black FW2, Color Black FW2V, Color Black FW18, Color Black FW200, Color Black S150, Color Black S160, Color Black S170, PRINTEX® 35, PRINTEX® U, PRINTEX® V, PRINTEX® 140U, Special Black 5, Special Black 4A, and Special Black 4). An example of an organic black pigment includes aniline black, such as C.I. Pigment Black 1.

Some examples of suitable yellow pigments include C.I. Pigment Yellow 1, C.I. Pigment Yellow 2, C.I. Pigment Yellow 3, C.I. Pigment Yellow 4, C.I. Pigment Yellow 5, C.I. Pigment Yellow 6, C.I. Pigment Yellow 7, C.I. Pigment Yellow 10, C.I. Pigment Yellow 11, C.I. Pigment Yellow 12, C.I. Pigment Yellow 13, C.I. Pigment Yellow 14, C.I. Pigment Yellow 16, C.I. Pigment Yellow 17, C.I. Pigment Yellow 24, C.I. Pigment Yellow 34, C.I. Pigment Yellow 35, C.I. Pigment Yellow 37, C.I. Pigment Yellow 53, C.I. Pigment Yellow 55, C.I. Pigment Yellow 65, C.I. Pigment Yellow 73, C.I. Pigment Yellow 74, C.I. Pigment Yellow 75, C.I. Pigment Yellow 81, C.I. Pigment Yellow 83, C.I. Pigment Yellow 93, C.I. Pigment Yellow 94, C.I. Pigment Yellow 95, C.I. Pigment Yellow 97, C.I. Pigment Yellow 98, C.I. Pigment Yellow 99, C.I. Pigment Yellow 108, C.I. Pigment Yellow 109, C.I. Pigment Yellow 110, C.I. Pigment Yellow 113, C.I. Pigment Yellow 114, C.I. Pigment Yellow 117, C.I. Pigment Yellow 120, C.I. Pigment Yellow 124, C.I. Pigment Yellow 128, C.I. Pigment Yellow 129, C.I. Pigment Yellow 133, C.I. Pigment Yellow 138, C.I. Pigment Yellow 139, C.I. Pigment Yellow 147, C.I. Pigment Yellow 151, C.I. Pigment Yellow 153, C.I. Pigment Yellow 154, C.I. Pigment Yellow 167, C.I. Pigment Yellow 172, C.I. Pigment Yellow 180, and C.I. Pigment Yellow 185.

Examples of suitable magenta or red organic pigments include C.I. Pigment Red 1, C.I. Pigment Red 2, C.I. Pigment Red 3, C.I. Pigment Red 4, C.I. Pigment Red 5, C.I. Pigment Red 6, C.I. Pigment Red 7, C.I. Pigment Red 8, C.I. Pigment Red 9, C.I. Pigment Red 10, C.I. Pigment Red 11, C.I. Pigment Red 12, C.I. Pigment Red 14, C.I. Pigment Red 15, C.I. Pigment Red 16, C.I. Pigment Red 17, C.I. Pigment Red 18, C.I. Pigment Red 19, C.I. Pigment Red 21, C.I. Pigment Red 22, C.I. Pigment Red 23, C.I. Pigment Red 30, C.I. Pigment Red 31, C.I. Pigment Red 32, C.I. Pigment Red 37, C.I. Pigment Red 38, C.I. Pigment Red 40, C.I. Pigment Red 41, C.I. Pigment Red 42, C.I. Pigment Red 48(Ca), C.I. Pigment Red 48(Mn), C.I. Pigment Red 57(Ca), C.I. Pigment Red 57:1, C.I. Pigment Red 88, C.I. Pigment Red 112, C.I. Pigment Red 114, C.I. Pigment Red 122, C.I. Pigment Red 123, C.I. Pigment Red 144, C.I. Pigment Red 146, C.I. Pigment Red 149, C.I. Pigment Red 150, C.I. Pigment Red 166, C.I. Pigment Red 168, C.I. Pigment Red 170, C.I. Pigment Red 171, C.I. Pigment Red 175, C.I. Pigment Red 176, C.I. Pigment Red 177, C.I. Pigment Red 178, C.I. Pigment Red 179, C.I. Pigment Red 184, C.I. Pigment Red 185, C.I. Pigment Red 187, C.I. Pigment Red 202, C.I. Pigment Red 209, C.I. Pigment Red 219, C.I. Pigment Red 224, C.I. Pigment Red 245, C.I. Pigment Violet 19, C.I. Pigment Violet 23, C.I. Pigment Violet 32, C.I. Pigment Violet 33, C.I. Pigment Violet 36, C.I. Pigment Violet 38, C.I. Pigment Violet 43, and C.I. Pigment Violet 50.

Examples of blue or cyan organic pigments include C.I. Pigment Blue 1, C.I. Pigment Blue 2, C.I. Pigment Blue 3, C.I. Pigment Blue 15, C.I. Pigment Blue 15:3, C.I. Pigment Blue 15:34, C.I. Pigment Blue 15:4, C.I. Pigment Blue 16, C.I. Pigment Blue 18, C.I. Pigment Blue 22, C.I. Pigment Blue 25, C.I. Pigment Blue 60, C.I. Pigment Blue 65, C.I. Pigment Blue 66, C.I. Vat Blue 4, and C.I. Vat Blue 60.

Examples of green organic pigments include C.I. Pigment Green 1, C.I. Pigment Green 2, C.I. Pigment Green 4, C.I. Pigment Green 7, C.I. Pigment Green 8, C.I. Pigment Green 10, C.I. Pigment Green 36, and C.I. Pigment Green 45.

Some examples of brown organic pigments include C.I. Pigment Brown 1, C.I. Pigment Brown 5, C.I. Pigment Brown 22, C.I. Pigment Brown 23, C.I. Pigment Brown 25, and C.I. Pigment Brown, C.I. Pigment Brown 41, and C.I. Pigment Brown 42.

Suitable examples of orange organic pigments include C.I. Pigment Orange 1, C.I. Pigment Orange 2, C.I. Pigment Orange 5, C.I. Pigment Orange 7, C.I. Pigment Orange 13, C.I. Pigment Orange 15, C.I. Pigment Orange 16, C.I. Pigment Orange 17, C.I. Pigment Orange 19, C.I. Pigment Orange 24, C.I. Pigment Orange 34, C.I. Pigment Orange 36, C.I. Pigment Orange 38, C.I. Pigment Orange 40, C.I. Pigment Orange 43, and C.I. Pigment Orange 66.

In another example, the pigment may be selected from metallic pigments, where the metallic pigments also have a particle size enabling the composition to be printed from an LEP printer. In an example, the particle size of the metallic pigment ranges from about 50 nm to about 3 μm. Suitable metallic pigments include, but are not limited to, a metal selected from gold, silver, platinum, nickel, chromium, tin, zinc, indium, titanium, copper, aluminum, and alloys of any of these metals. These metals may be used alone or in combinations with two or more metals or metal alloys. Examples of metallic pigments include Standard R0100, Standard R0200, and DORADO PX™ 4001 (available from Eckart Effect Pigments, Wesel, Germany).

In yet another example, the pigment may be selected from a pearlescent pigment (also known as an opalescent pigment), where the pearlescent pigments have a particle size that enable the composition to be printed from a piezoelectric inkjet pen. In an example, the pearlescent particle size ranges from about 50 nm to about 3 μm. It is to be understood that suitable pearlescent pigments are those that tend to exhibit various colors depending on the angle of illumination and/or of viewing. Examples of pearlescent pigments include those of the PRESTIGE® series and of the DORADO PX™ series, both of which are available from Eckart Effect Pigments.

Other examples of pigments that may be used include inorganic particles, such as alumina, titanium dioxide, and zinc oxide.

It is to be understood that a single pigment or a mixture of two or more pigments may be used as the pigment core of the toner particles. In an example, the amount of pigment(s) present in the liquid toner ranges from about 0.5 wt % to about 50 wt % of the liquid toner. In another example, the amount of pigment(s) ranges from about 1 wt % to about 25 wt %, and in yet another example, ranges from about 2 wt % to about 5 wt % of the liquid toner.

In an example, the toner composition may also include a dye to impart color to the composition. The dye, if used, may be chosen from water- or solvent-soluble dyes, and the dye may be present in an amount ranging from about 0.1 wt % to about 10 wt % of the toner composition. The polymer resin (partially or fully) encapsulating the pigment particle core of the toner particles may be referred to herein as a polymer resin shell. This polymer resin shell may be permanently established on the pigment core such that the polymer resin shell non-reversibly encapsulates the pigment. This is in contrast to thermodynamically reversible coatings such as, e.g., those formed in self-assembling processes. The permanent establishment may be accomplished via covalent bonding when the polymer resin chemically reacts with the pigment. The polymer resin shell may otherwise be attached to the pigment through physical bonding, such as, e.g., through hydrogen bonding, Van der Waals interactions, Zwitterionic interactions, or the like. An example of the polymer resin for the polymer resin shell includes polyethylene resins available, e.g., from E.I. du Pont de Nemours and Co., Wilmington, Del.

As previously mentioned, a charge director is incorporated into the toner composition, and when attached to the toner particles (i.e., the pigment particles encapsulated by the polymer resin), imparts a charge to the toner particles producing charged toner particles. Examples of suitable charge directors that may be incorporated into the toner composition include lecithin, oil-soluble petroleum sulfonates (e.g., neutral calcium petronate, neutral barium petronate, and basic barium petronate), polybutylene succinimides (e.g., OLOA 1200), glyceride salts (e.g., sodium salts of phosphate mono- and diglycerides with unsaturated and saturated acid substituents), sulfonic acid salts (e.g., barium, sodium, calcium, and aluminum salts of sulfonic acid), oxyphosphate metal salts, or mixtures/combinations thereof. The sulfonic acids may include alkyl sulfonic acids (e.g., alkyl-benzenesulfonic acid), aryl sulfonic acids, sulfonic acids of alkyl succinates, and mixtures/combinations thereof. The amount of charge director will depend, at least in part, upon the total weight of the toner particles that are present in the non-polar carrier liquid. In one example, the charge director is present in an amount ranging from about 0.1 wt % to about 10 wt % of the liquid toner.

The latex particles are incorporated into the non-polar carrier of the toner composition described above. The latex particles also form a substantially homogeneous mixture (as observed with the human eye) with the pigment toner particles of the toner composition. These latex particles are polymer particles formed from the polymerization of acrylic monomers, vinylic monomers, or mixtures of acrylic monomer(s) and vinylic monomer(s). Examples of acrylic monomers include alkyl acrylates, alkyl methacrylates, and monomers including more than one polymerizable acrylic group. Some specific examples of acrylic monomers are methyl methacrylate, butyl methacrylate, hexyl acrylate, hexyl methacrylate, 2-ethylhexyl acrylate, 2-ethylhexy methacrylate, lauryl acrylate, lauryl methacrylate, stearyl methacrylate, acrylic acid, methacrylic acid, ethylene glycol dimethacrylate, pentaerythritol tri-acrylate, pentaerythritol tetra-acrylate, pentaerylthritol tri-methacrylate, pentaerythritol tetra-methacrylate, acrylonitrile, methacrylonitrile, or combinations thereof. Some of the listed acrylic monomers (e.g., alkyl acrylates and alkyl methacrylates) also include vinyl groups. Examples of vinylic monomers include styrene, substituted styrene, and monomers including more than one polymerizable vinylic group. Some specific examples of these vinylic monomers include divinylbenzene, chloromethyl styrene, and methylstyrene. In an example, the latex particles are present in an amount ranging from about 1 wt % to about 60 wt % of the liquid toner. In other examples the amount of the latex particles present in the liquid toner ranges from about 5 wt % to about 40 wt %, while in other examples, the amount of latex particles present ranges from about 15 wt % to about 30 wt %.

The latex particles for the toner also have a glass transition temperature ($T_g$) ranging from about 45° C. to about 120° C. It is believed that at a lower $T_g$ (e.g., at 20° C.), the LEP printing process may be affected, at least in terms of the development and transfer processes. On the other hand, at a higher $T_g$ (e.g., greater than 120° C.), a higher fusing temperature may be required to form a film during LEP printing. If more than one monomer is used to produce the latex particles (e.g., multiple acrylic or vinylic monomers or a mixture of an acrylic monomer and a vinylic monomer), then the $T_g$ of the polymerized latex particles may be estimated using the Fox equation (Equation 1 below). The Fox equation may be used to relate the molecular weight of a polymer system to the glass transition temperature:

$$\frac{1}{T_g} = \frac{w_1}{T_{g1}} + \frac{w_2}{T_{g2}} \quad \text{(Equation 1)}$$

where $w_1$ and $w_2$ are the weight fractions of copolymer components 1 and 2, respectively, and $T_{g1}$ and $T_{g2}$ are the glass transitions temperatures of the copolymer components 1 and 2, respectively. Generally, the $T_g$ of the copolymer is affected by the $T_g$ of the homopolymers in the polymer system.

In an example, the latex particles are commercially available. Some examples of commercially available latex particles include styrene acrylic latex particles of the RAYREZ™ family (e.g., RAYREZ™ 182A, RAYREZ™ 182D, and RAYREZ™ 200) and of the RAYKOTE™ family (e.g., RAYKOTE™ 1589), all of which are available from Specialty Polymers, Inc., Chester, S.C.

In an example, the liquid toner includes the toner composition having latex particles alone incorporated therein. In another example, the liquid toner includes polyethylene resin particles in addition to the latex particles, and both are incorporated into the toner composition. In instances where polyethylene resin particles are used, the polyethylene particles may be present in an amount of up to 60 wt % of the liquid toner.

One example of a method for making the liquid toner may be described with reference to FIG. 1E alone. This example includes adding, in a container 16, toner particles and a charge director to a non-polar liquid carrier to form the toner composition, and then adding the purchased latex particles to the toner composition to form the liquid toner.

In another example, the latex particles may be prepared, and these particles may be incorporated into the toner composition to form the liquid toner. This example of the method for making the ink will be described below in detail in conjunction with FIGS. 1A through 1E. Very generally, this example of the method includes preparing a latex particle dispersion (described below in conjunction with FIGS. 1A through 1D), and then incorporating the latex particle dispersion into the toner composition (described below in conjunction with FIG. 1E).

Rather than purchasing the latex particles, they may be synthesized. A schematic illustration of the synthesis is shown in FIGS. 1A through 1D. An example of the method for preparing a latex particle dispersion includes initially forming a monomer emulsion by emulsifying one or more monomers in water. The monomers to be emulsified include one or more of the previously described acrylic monomers, one or more of the previously described vinylic monomers, or a combination of the previously described acrylic monomer(s) and vinylic monomer(s). As shown in FIG. 1A, the monomers M are emulsified in water in a container 10. In an example, the monomers M are emulsified in a combination of water and a surfactant. The surfactant may be an anionic surfactant, such as MAXEMUL™ 6106 available from Croda Inc. (Edison, N.J.) or the like. Emulsification of the monomers in water (or in water and surfactant) to form the latex particles may be accomplished using any emulsion-based process. Examples of such an emulsion-based process include a mini-emulsion process and a reduction-oxidation (redox) polymerization process.

In another container 12, as shown in FIG. 1B, an initiator solution may be prepared by dissolving an initiator I in water. The initiator I may be chosen from free-radical initiators, such as azo compounds and organic peroxides. The initiator I may also be chosen from reduction-oxidation (i.e., redox) initiators, an example of which includes a persulfate salt (e.g., potassium persulfate and ammonium persulfate). In one example, about 2.5 g of initiator is added for about every 130 ml of water. It is to be understood, however, that the amount of initiator may vary depending, at least in part, on the monomer composition. In an example, the amount of initiator ranges from about 0.2 wt % to about 2.5 wt % with respect to the total amount of monomers.

Meanwhile, in yet another container 14, water is heated to a temperature ranging from about 50° C. to about 95° C. In one example, the water is heated to about 90° C. Some of the initiator I may be added to the heated water. In an example, about 0.6 g of the initiator I is added to the heated water. The initiator solution (i.e., the initiator I in water shown in container 12) is added to the heated water.

The monomer emulsion formed in the container 10 is also added to the heated water in container 14 (as also shown in FIG. 1B), and then all of the contents added to the container 14 are mixed together to form a reaction mixture at an elevated temperature (as shown in FIG. 1C). In an example, the monomer emulsion is slowly added to the heated water at the same time that the initiator solution is added to the heated water. This may be accomplished over a predetermined period of time (i.e., a time that allows polymerization of the monomers to take place). Mixing may be accomplished, for instance, by stirring at various speeds. Further, the mixing may be accomplished while maintaining the temperature of the reaction mixture at about 90° C. for the predetermined period of time. It is to be understood that, during the mixing and while being exposed to the elevated temperature, the monomer(s) in the reaction mixture polymerize to form a final solution containing polymerized particles dispersed in liquid components (e.g., water) (FIG. 1C). After polymerization is complete (which may occur, e.g., after about 2 hours from when the monomers are added), the final solution is cooled, e.g., to ambient temperature.

The pH of the final solution (i.e., the latex particles in water shown in container 14 in FIG. 1C) may be adjusted to a value ranging from about 5 to about 9 utilizing a suitable pH adjuster. In some examples, the pH is adjusted to a value ranging from 5 to 8.5. If, for instance, the final solution is acidic, then a 50% potassium hydroxide solution may be used to adjust the pH to about 7.

The final solution may then be filtered using, e.g., a mesh filter to obtain latex particles in water having about 20% solids content. Thereafter, the latex particles are separated from the liquid components of the final solution to obtain the solid latex particles alone, as shown in FIG. 1D. Separation of the liquid components from the solid particles may be accomplished via any method for removing the water from the final solution. In an example, liquid/solid separation or removal of about 100% of the liquid may be accomplished at ambient temperature, e.g., by forced air circulation, freeze-drying, or the like.

The toner composition may be prepared in yet another container 16, as shown in FIG. 1E, and then the latex polymer particles produced in the steps shown in FIGS. 1A through 1D may be added to the toner composition in the container 16. Alternately, the toner composition may be prepared and added to the container 14 containing the latex polymer particles. In an example, the toner composition may be made by incorporating the toner particles and the charge director in the liquid carrier. Then, as shown in FIG. 1E, the latex polymer particles are added to and mixed with the toner composition in container 16. In still another example, the toner composition may be purchased (e.g., ElectroInk™ by HP) and then the prepared latex particles may be added to the toner composition in container 16. In this example, the formation process of the commercially available toner composition is not altered because the latex particles may be added at the last stage of toner composition production.

While not shown in FIGS. 1A through 1E, it is to be understood that the latex polymer particles produced via the method shown in FIGS. 1A through 1D may be mixed with some of the same carrier that is used in the toner composition before being mixed into the toner composition (e.g., carrier, toner particles, and charge director). For example, the latex polymer particles shown in FIG. 1D may be mixed with carrier, etc. via jar milling or another suitable mixing technique. This may be accomplished to further reduce the particle size of the latex polymer particles. This mixture may then be added to the toner composition.

To further illustrate the present disclosure, examples are given herein. It is to be understood that these examples are provided for illustrative purposes and are not to be construed as limiting the scope of the present disclosure.

EXAMPLES

Example 1

A latex particle dispersion was prepared that contained latex polymer particles having an individual particle size of about 250 nm. First, a monomer emulsion was prepared by emulsifying about 230 g of styrene monomer, about 80 g of butyl acrylate monomer, about 100 mL of methacrylonitrile monomer, about 2.4 g of ethylene glycol dimethacrylate monomer, and about 8 g of methacrylic acid in about 136 mL of water. The water also contained about 3.2 g of MAX-EMUL™ 6106 surfactant.

In a separate container, an initiator solution was prepared by dissolving about 2.6 g of potassium persulfate (KPS) in about 130 mL of water. A separate container of about 1160 mL water was heated to about 90° C., and about 0.6 g of KPS was added to the hot water. The initiator solution was then added to the hot water at a rate so that the initiator solution was added over a 50 minute time duration. The emulsion described above was added to the hot water over the 50 minute period of time. As the emulsion was added, the polymerization of the monomers in the emulsion was initiated by the presence of the initiator, and polymerization of the monomers continued for a period of about 2.5 hours while the reaction temperature was maintained at about 90° C.

Figure 2A:
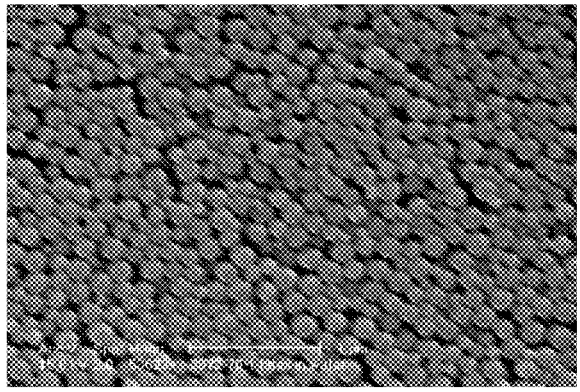
FIGS. 2A and 2B are scanning electron microscope (SEM) images of latex particles having been dispersed in water (FIG. 2A) and having been dispersed in ISOPAR® L (FIG. 2B)

After reacting for 2.5 hours, the reaction mixture was cooled to ambient temperature. The final mixture included polymerized particles dispersed in the liquid components (i.e., the water and surfactant). The pH of this final mixture was then adjusted to about 7.2 by adding a 50% potassium hydroxide solution to the final mixture. The polymerized particles were then filtered using a 200 mesh filter to obtain particles in water having about 20% solids content. The particle size of the polymer particles was then measured using a dynamic light scattering tool, e.g., a NiComp™ Particle Analyzer (Particle Sizing Systems, Port Richey, Fla.), indicating that the average particle size was about 269 nm. About 100% of the water was then removed (perhaps trace amounts of water, e.g., less than about 0.1% may have remained) from the polymer particles at room temperature (e.g., about 22° C.) by forced air to obtain solid polymer particles. It is desirable that no more than about 1% of water remain because the presence of the water may increase conductivity, and may affect the development process during LEP printing. An electron scanning microscope (SEM) micrograph of the polymer particles after water removal is shown in FIG. 2A. The fact that the particles look spherical and retain their particle size distribution suggests good dispersibility and stability of the latex particles in water.

Figure 2B:
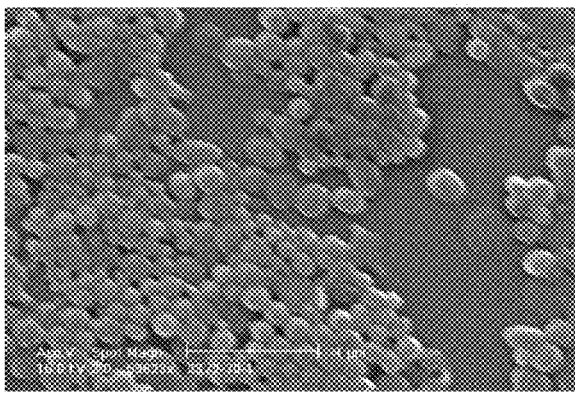

A portion of the solid polymer particles (about 30 g) was mixed with about 112.5 g of ISOPAR® L and about 7.5 g of a dispersant (OS#13309AQ, obtained from Lubrizol Corporation, Wickliffe, Ohio). The mixture was jar milled with about 500 g of 2 mm zirconia beads for about 17 hours, and then the beads were removed. The average particle size of polymer particles in this mixture was measured to be about 250 nm. The ISOPAR® L was removed. An SEM micrograph of these polymer particles was taken and is shown in FIG. 2B. The fact that the particles look spherical and retain their particle size distribution suggests good dispersibility and stability of the latex particles in ISOPAR® L.

Both FIGS. 2A and 2B suggest that the latex particles disclosed herein demonstrate good dispersibility and stability in a variety of solvent systems.

Example 2

Another latex particle dispersion was made using the same process described above for Example 1; however, the monomers included about 318 g of styrene monomer, about 72 g of butyl acrylate monomer, about 2.4 g of ethylene glycol dimethacrylate monomer, and about 8 g of methacrylic acid monomer. The particle size of the latex particles was measured to be about 250 nm in ISOPAR® L.

Example 3

Latex particles by the tradename RAYKOTE™ 1589 were purchased as a mixture of particles in water. The water was removed from the mixture to obtain the solid latex particles, which were then dispersed in ISOPAR® L similar to the method described above in Example 1. This particle dispersion is referred to herein as Sample 1.

The polymer latex particles formed in Example 1 were dispersed in ISOPAR® L at a concentration of 16.7 wt % (Sample 2) and 20 wt % (Sample 3).

Figure 3:
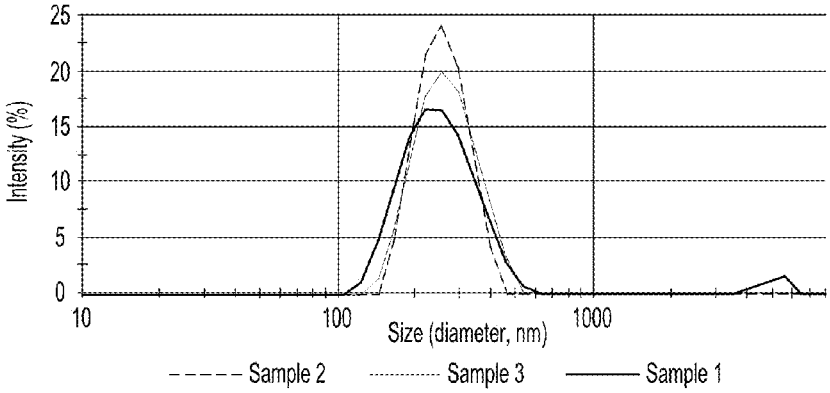
FIG. 3 is a graph showing the dynamic light scattering (DLS) size distribution of three different types of latex particles dispersed in ISOPAR® L.

A dynamic light scattering (DLS) size distribution was produced for each of the particle dispersions (i.e., Samples 1, 2, and 3), and the DLS size distribution graph is shown in FIG. 3. The graph shown in FIG. 3 depicts the size distribution of the small polymer particles in the suspension as a result of how the polymer particles scatter light. The graph shown in FIG. 3 depicts the scattering of light in terms of intensity (%) as a function of the size of the particles. As shown in the graph, a particle size distribution for each of the particle types of Samples 1 and 2 measured within the range of about 200 nm to about 300 nm. It is noted that Sample 3 alone exhibited a small amount of particles falling within a particle size range of about 5 microns to about 6 microns.

Example 4

The latex particles formed in Example 1 were added to enough ISOPAR® L to form a latex particle dispersion with 10 wt % non-volatile solids (NVS).

The toner composition used was an HP® Indigo Yellow ElectroInk, which was altered so that the ElectroInk contained 0.1 wt % of non-volatile solids (NVS). This was accomplished by diluting the ElectroInk using ISOPAR® L.

A yellow liquid toner was prepared by incorporating 0.2 g of the 10% NVS latex dispersion to 100 g of the 0.1 wt % NVS toner composition. The yellow liquid toner was shaken and plated on a Q/m cell. It was found that the yellow liquid toner developed uniformly; i.e., no particles (i.e., latex particles and toner particles) were found on the other side of the electrode of the Q/m cell.

Example 5

The latex particle dispersion with 10 wt % non-volatile solids (NVS) and the toner composition with 0.1 wt % of non-volatile solids (NVS) as described in Example 4 were used in this example.

A yellow liquid toner was prepared by incorporating 0.4 g of the 10% NVS latex dispersion to 100 g of the 0.1 wt % NVS toner composition. The yellow liquid toner was shaken and plated on a Q/m cell. It was found that the yellow liquid toner developed uniformly; i.e., no particles (i.e., latex particles and toner particles) were found on the other side of the electrode of the Q/m cell.

Example 6

The latex particle dispersion with 10 wt % non-volatile solids (NVS) and the toner composition with 0.1 wt % of non-volatile solids (NVS) as described in Example 4 were used in this example.

A yellow liquid toner was prepared by incorporating 0.6 g of the 10% NVS latex dispersion to 100 g of the 0.1 wt % NVS toner composition. The yellow liquid toner was shaken and plated on a Q/m cell. It was found that the yellow liquid toner developed uniformly; i.e., no particles (i.e., latex particles and toner particles) were found on the other side of the electrode of the Q/m cell.

Example 7

A scratch resistance test was performed on a print formed by printing the yellow liquid toner of Example 6, and on a comparative print formed by printing the HP® Indigo yellow ElectroInk™ (EI4.5Y). The tests were performed using a Taber scratch tester using a 50 g weight and a standard diamond tip. The scratch resistance test was performed for 10 cycles on both the print and the comparative print.

Figure 4A:
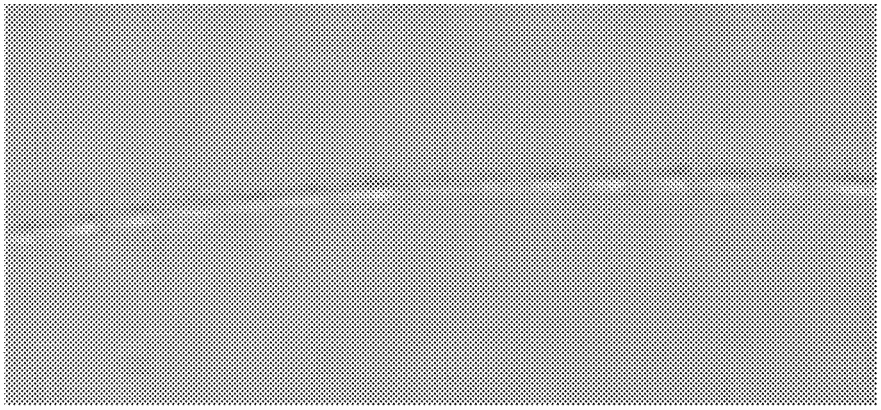
FIGS. 4A and 4B are schematic representations of scratch test results of prints formed by printing a comparative liquid toner that does not include latex particles (FIG. 4A) and a liquid toner that does contain latex particles (FIG. 4B).
Figure 4B:
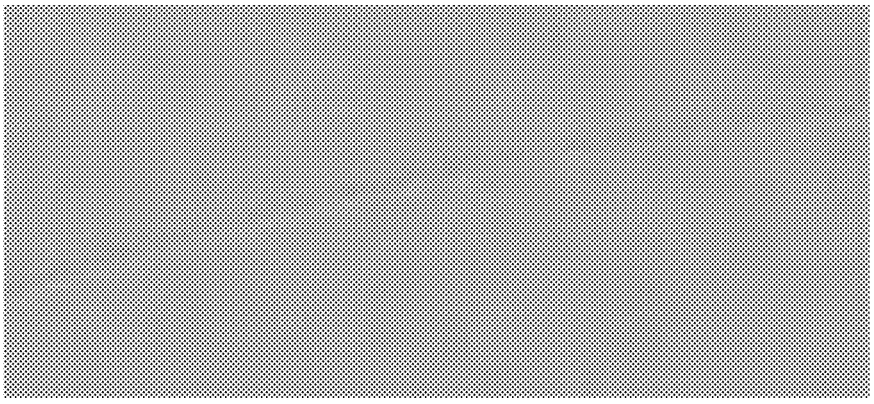

FIGS. 4A and 4B illustrate schematic representations of the scratch test results after the 10 scratch cycles for the comparative print and the print, respectively. As depicted, the print formed using the yellow liquid toner of Example 6 was more scratch resistant (FIG. 4B) than the print formed using the HP® Indigo yellow ElectroInk™ (FIG. 4A).

As illustrated by the results of Example 7, the addition of the latex particles to the toner composition results in a liquid toner with improved durability, when compared to toners including polyethylene based resins but no latex particles. Some of the latex particles disclosed herein include ester groups, which are believed to increase adhesion and improve cohesive forces, which enhances durability.

It is to be understood that the ranges provided herein include the stated range and any value or sub-range within the stated range. For example, a range from about 20 nm to about 5 μm should be interpreted to include not only the explicitly recited limits of about 20 nm to about 5 μm, but also to include individual values, such as 50 nm, 100 nm, 1 μm, etc., and sub-ranges, such as from about 100 nm to about 1 μm, from about 200 nm to about 1.5 μm, etc. Furthermore, when "about" is utilized to describe a value, this is meant to encompass minor variations (up to +/−5%) from the stated value.

While several examples have been described in detail, it will be apparent to those skilled in the art that the disclosed examples may be modified. Therefore, the foregoing description is to be considered non-limiting.

What is claimed is:

1. A liquid toner, comprising:

a toner composition including charged toner particles incorporated into a non-polar liquid carrier;

polyethylene resin particles incorporated into the toner composition; and latex copolymer particles incorporated into the toner composition, the latex copolymer particles formed of monomers selected from the group consisting of acrylic monomers, vinylic monomers, and mixtures thereof, and each latex copolymer particle having a particle size ranging from about 20 nm to about 5 μm.

2. The liquid toner as defined in claim 1 wherein the acrylic monomers are selected from the group consisting of alkyl acrylates, alkyl methacrylates, and monomers including more than one polymerizable acrylic group.

3. The liquid toner as defined in claim 1 wherein the acrylic monomers are selected from the group consisting of methyl methacrylate, butyl acrylate, butyl methacrylate, hexyl acrylate, hexyl methacrylate, 2-ethylhexyl acrylate, 2-ethylhexyl methacrylate, lauryl acrylate, lauryl methacrylate, stearyl methacrylate, acrylic acid, methacrylic acid, ethylene glycol dimethacrylate, pentaerythritol tri-acrylate and pentaerythritol tetra-acrylate, pentaerythritol tri-methacrylate, pentaerythritol tetra-methacrylate, acrylonitrile, methacrylonitrile, and combinations thereof.

4. The liquid toner as defined in claim 1 wherein the vinylic monomers are selected from the group consisting of styrene, substituted styrene, and monomers including more than one polymerizable vinylic group.

5. The liquid toner as defined in claim 4 wherein the vinylic monomers are selected from the group consisting of divinylbenzene, chloromethyl styrene, and methylstyrene.

6. The liquid toner as defined in claim 1 wherein the latex copolymer particles have a glass transition temperature ($T_g$) ranging from about 45° C. to about 120° C.

7. The liquid toner as defined in claim 1 wherein the latex copolymer particles are dispersed in a carrier, the carrier being chosen from a liquid hydrocarbon.

8. The liquid toner as defined in claim 7 wherein the liquid hydrocarbon is selected from the group consisting of isoparaffinic hydrocarbons and low polarity hydrocarbons.

9. The liquid toner as defined in claim 1 wherein the latex copolymer particles are present in an amount ranging from about 1 wt % to about 60 wt % of the liquid toner.

10. A method of making a liquid toner, comprising:

preparing a latex particle dispersion including latex copolymer particles formed of monomers selected from the group consisting of acrylic monomers, vinylic monomers, and mixtures thereof, each latex copolymer particle having a particle size ranging from about 20 nm to about 5 μm;

removing liquid components from the latex particle dispersion, thereby separating out the latex copolymer particles; and incorporating the latex copolymer particles into a toner composition including charged toner particles and polyethylene resin particles incorporated into a non-polar liquid carrier.

11. The method as defined in claim 10 wherein the preparing of the latex particle dispersion is accomplished by:

forming a monomer emulsion by emulsifying the acrylic monomers, the vinylic monomers, or a mixture of acrylic monomers and vinylic monomers in water;

forming an aqueous solution containing an initiator;

adding the monomer emulsion to the aqueous solution to form a reaction mixture; and exposing the reaction mixture to an elevated temperature for a predefined period of time, thereby polymerizing the acrylic monomers, the vinylic monomers, or the mixture of the acrylic monomers and the vinylic monomers to form the latex copolymer particles.

12. The method as defined in claim 11 wherein the initiator is chosen from potassium persulfate.

13. A liquid toner, consisting of:

a toner composition of charged toner particles incorporated into a non-polar liquid carrier;

polyethylene resin particles incorporated into the toner composition; and latex copolymer particles incorporated into the toner composition, the latex copolymer particles formed of monomers selected from the group consisting of acrylic monomers, vinylic monomers, and mixtures thereof, and each latex copolymer particle having a particle size ranging from about 20 nm to about 5 μm.

14. The liquid toner as defined in claim 1 wherein the polyethylene resin particles are present in an amount of up to 60 wt % of the liquid toner.

15. The liquid toner as defined in claim 1 wherein the latex copolymer particles are latex copolymer particles of about 230 g of styrene monomer, about 80 g of butyl acrylate monomer, about 100 mL of methacrylonitrile monomer, about 2.4 g of ethylene glycol dimethacrylate monomer, and about 8 g of methacrylic acid monomer.

16. The liquid toner as defined in claim 1 wherein the latex copolymer particles are latex copolymer particles of about 318 g of styrene monomer, about 72 g of butyl acrylate monomer, about 2.4 g of ethylene glycol dimethacrylate monomer, and about 8 g of methacrylic acid monomer.

* * * * *